US009404370B2

(12) United States Patent
Scheuermann et al.

(10) Patent No.: US 9,404,370 B2
(45) Date of Patent: Aug. 2, 2016

(54) EXHAUST-GAS TURBOCHARGER COMPONENT WITH MICROSTRUCTURED SURFACE

(75) Inventors: Timo Scheuermann, Mainz (DE); Stefan Ebert, Kindenheim (DE)

(73) Assignee: BorgWarner Inc., Auburn Hills, MI (US)

( * ) Notice: Subject to any disclaimer, the term of this patent is extended or adjusted under 35 U.S.C. 154(b) by 727 days.

(21) Appl. No.: 13/816,975

(22) PCT Filed: Aug. 18, 2011

(86) PCT No.: PCT/US2011/048245

§ 371 (c)(1),
(2), (4) Date: Feb. 14, 2013

(87) PCT Pub. No.: WO2012/027197

PCT Pub. Date: Mar. 1, 2012

(65) Prior Publication Data

US 2013/0142662 A1 Jun. 6, 2013

(30) Foreign Application Priority Data

Aug. 26, 2010 (DE) ..... 10 2010 035 486

(51) Int. Cl.

| | |
|---|---|
| ***F01D 5/14*** | (2006.01) |
| ***F01D 9/02*** | (2006.01) |
| ***F15D 1/00*** | (2006.01) |
| *F15D 1/06* | (2006.01) |

(52) U.S. Cl.

CPC ..... *F01D 5/147* (2013.01); *F01D 9/026* (2013.01); *F15D 1/005* (2013.01); *F05D 2220/40* (2013.01); *F05D 2250/28* (2013.01); *F15D 1/065* (2013.01)

(58) Field of Classification Search

CPC ..... F01D 9/026; F01D 5/147; F05D 2220/40; F05D 2250/28; F15D 1/065; F15D 1/002

See application file for complete search history.

(56) References Cited

U.S. PATENT DOCUMENTS

| | | | | | |
|---|---|---|---|---|---|
| 3,893,787 | A * | 7/1975 | Jones | F04D 29/685 | 415/173.5 |
| 4,063,848 | A * | 12/1977 | Wiggins | F04D 27/02 | 415/172.1 |
| 4,212,585 | A * | 7/1980 | Swarden | F04D 27/0215 | 415/198.1 |
| 4,930,979 | A * | 6/1990 | Fisher | F04D 27/0215 | 415/206 |
| 5,466,118 | A * | 11/1995 | Heinrich | F04D 29/4213 | 415/208.3 |
| 6,582,189 | B2 * | 6/2003 | Irie | F01D 5/145 | 415/119 |
| 6,742,989 | B2 * | 6/2004 | Osako | F01D 5/048 | 415/204 |
| 2004/0194751 | A1 * | 10/2004 | Limbrunner | F02B 29/02 | 123/184.61 |
| 2006/0275113 | A1 * | 12/2006 | Chen | F04D 29/4206 | 415/206 |
| 2008/0056882 | A1 * | 3/2008 | Clay | F02C 6/12 | 415/55.6 |

FOREIGN PATENT DOCUMENTS

| | | | |
|---|---|---|---|
| DE | 102008024115 | A1 | 11/2009 |
| JP | 05-149204 | A | 6/1993 |
| JP | 2001-280311 | A | 10/2001 |
| WO | 03-095811 | A1 | 11/2003 |

* cited by examiner

*Primary Examiner* — Igor Kershteyn

(74) *Attorney, Agent, or Firm* — A. Michael Tucker; Stephan A. Pendorf; Patent Central LLC

(57) ABSTRACT

An exhaust-gas turbocharger component (10) having at least one flow-conducting component surface (11) and having a discontinuity structure (12) which is formed on the component surface (11). The discontinuity structure (12) has a multiplicity of punctiform depressions (13) which are arranged separately from one another on at least one part of the component surface (11).

12 Claims, 4 Drawing Sheets

EXHAUST-GAS TURBOCHARGER COMPONENT WITH MICROSTRUCTURED SURFACE

BACKGROUND OF THE INVENTION

1. Field of the Invention

The invention relates to an exhaust-gas turbocharger component with a microstructured surface.

2. Description of the Related Art

A component of said type is known from DE 10 2008 024 115 A1. Said document describes, as an example of such a component, a compressor wheel which is provided with a sharkskin-like microstructure. Said microstructure is characterized by grooves which have groove widths in a range from 30 μm to 50 μm and groove heights in a range from 15 μm to 25 μm. Said grooves form elongate ducts which are situated adjacent to one another and which have the stated width and height ranges and between which are arranged partitions which taper to a point and which form the sharkskin-like microstructure.

With said microstructure, it is supposedly possible to at least reduce flow detachment from flow-guiding components of an exhaust-gas turbocharger, which supposedly results in a considerably broader working characteristic map of the compressor or of the exhaust-gas turbocharger.

A problem with said design is firstly the microstructure in the μm range, which is difficult to manufacture. Furthermore, tests carried out within the context of the invention have yielded that, in particular in the case of curved flow-conducting component surfaces, further improvements over the known micro-surface are desirable.

It is therefore an object of the present invention to provide an exhaust-gas turbocharger component which is easy to manufacture and which has improved flow-conducting capability in relation to the prior art.

BRIEF SUMMARY OF THE INVENTION

As a result of the provision of a discontinuity structure which has a multiplicity of punctiform depressions, it is possible to form discontinuities even in small regions in order to obtain a local turbulent flow. In this way, in turn, the air/flow resistance at the thermodynamic boundary layer of the respective component is reduced, which in turn has the result that the maximum proportion of the air/exhaust-gas mass flow which is conducted through an exhaust-gas turbocharger can form a virtually ideal laminar flow, and improved efficiencies can be attained in this way.

Here, the discontinuities or depressions of the discontinuity structure may be provided for all the flow-conducting components of an exhaust-gas turbocharger. Examples of this are the turbine housing and the compressor housing or the flow-conducting inner surfaces thereof, connecting elements (for example pipes in R2S applications), valves (in particular the surface of valve closure bodies), flap parts and the turbine wheels and compressor wheels.

In principle, further applications in the automobile field are also conceivable, such as for example intake-side and/or pressure-side lines and/or connecting elements in the engine bay for passenger motor vehicle and utility vehicle applications and also for exhaust manifolds and/or for the exhaust tract.

The subclaims relate to advantageous refinements of the invention.

The depressions of the discontinuity structure may be provided over entire component surfaces or only on parts of the component surface in a targeted fashion in order to produce a geometric modification of said component surface.

Said depressions may vary in number, arrangement, shape and depth, depending on the component. It is likewise possible for depressions of different shape and depth to be provided on one and the same component surface.

Primarily round, elliptical and polygonal cutouts are particularly preferable as shapes for the depression.

Furthermore, the depressions or discontinuities in the component surface may particularly advantageously be manufactured by casting (by core formation, by means of the external geometry of molding tools, or also in rapid prototyping processes). In the case of components which are accessible after the casting process, mechanical reworking is also possible in principle. It is also advantageous for the discontinuity structure according to the invention to be a macrostructure in the range of tenths of a millimeter, which is easy to manufacture.

BRIEF DESCRIPTION OF THE SEVERAL VIEWS OF THE DRAWINGS

Further details, advantages and features of the present invention will emerge from the following description of exemplary embodiments on the basis of the drawing, in which.

DETAILED DESCRIPTION OF THE INVENTION

Figure 1:
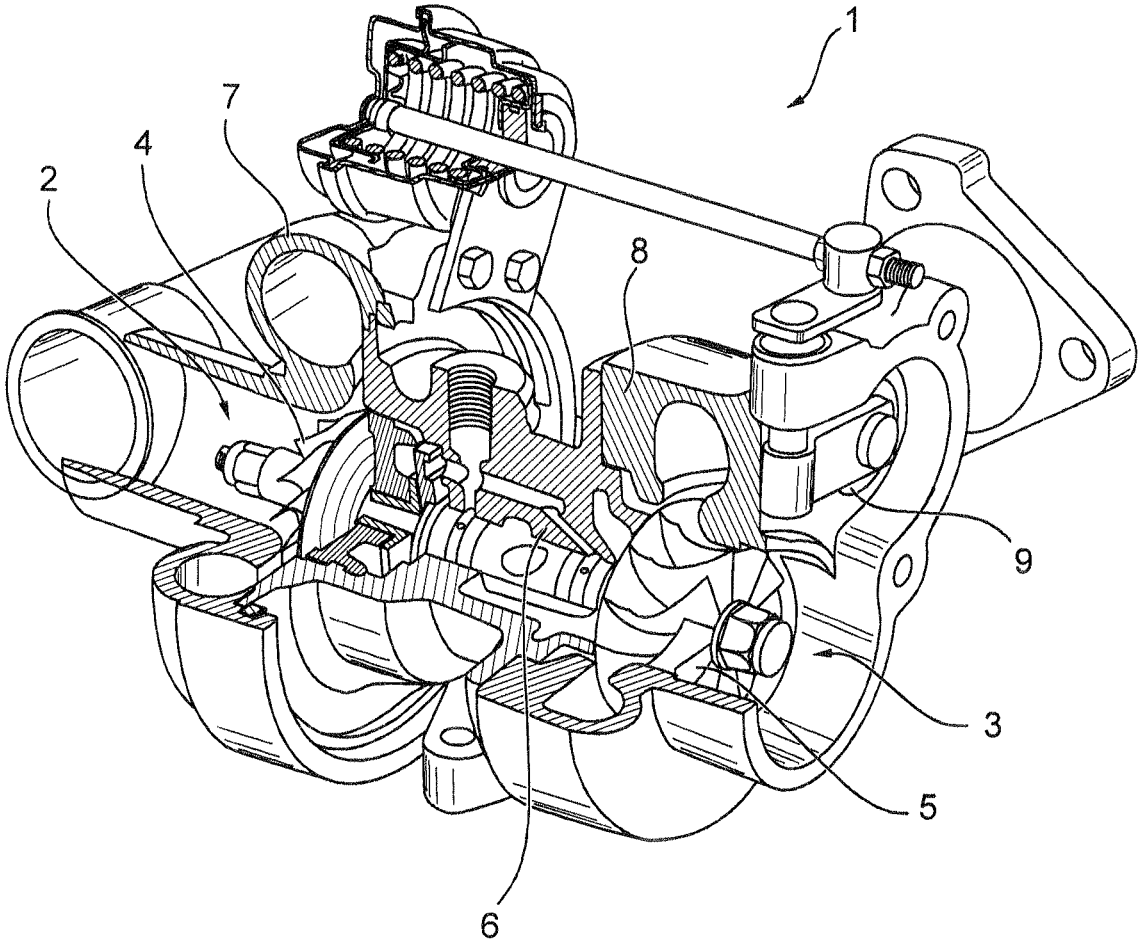
FIG. 1 shows a perspective cut-away illustration of an exhaust-gas turbocharger according to the invention in which an exhaust-gas turbocharger component according to the invention can be used.

FIG. 1 shows an example of an exhaust-gas turbocharger 1 which has a compressor 2 with compressor wheel 4 in a compressor housing 7 and which has a turbine 3 with turbine wheel 5 in a turbine housing 8. Also arranged in the turbine housing 8 is a wastegate flap 9 which can be actuated by means of a conventional regulating device.

Said exhaust-gas turbocharger 1 is an example of a turbocharger which can be provided with an exhaust-gas turbocharger component to be described below.

Figure 2:
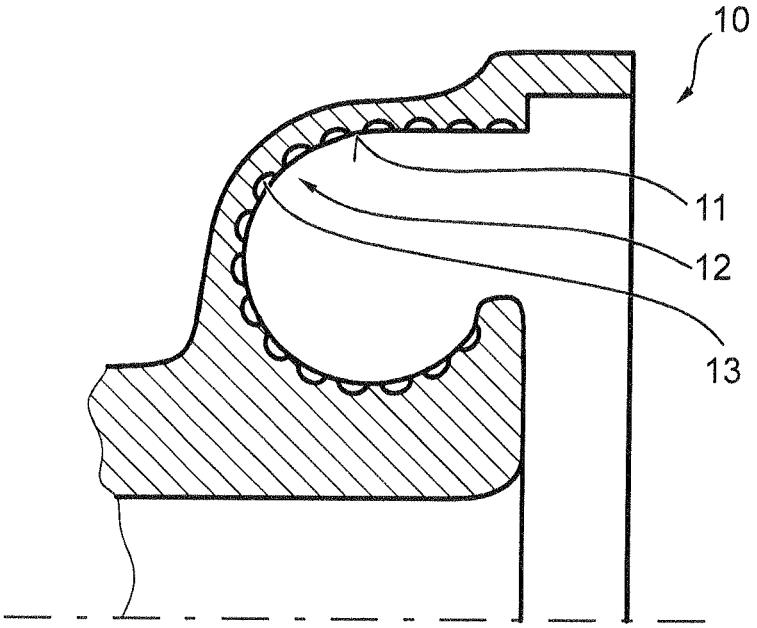
FIG. 2 shows a schematically highly simplified illustration of a compressor housing as an example of an exhaust-gas turbocharger component according to the invention.

FIG. 2 shows a schematically highly simplified illustration of the compressor housing 7 as an example of an exhaust-gas turbocharger 10 according to the invention. Said component 10 has a flow-guiding component surface 11 which, in this case, guides fresh air to be sucked in by the compressor 2. The component surface 11 is provided with a discontinuity structure 12 formed from a multiplicity of punctiform depressions 13. Said depressions 13 are arranged separately from one another on at least a part of the component surface 11. The number, shape, arrangement and dimensioning of said depressions 13 may be adapted depending on the application or component type.

Figure 3:
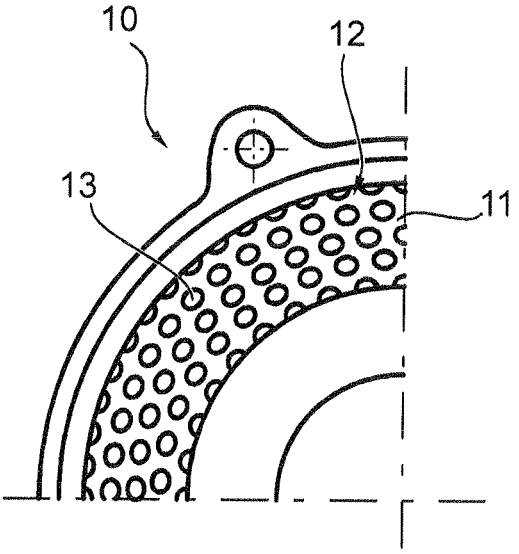
FIG. 3 shows a plan view of the component surface, which is provided with a discontinuity structure, of the compressor housing according to FIG. 2.

FIG. 3 shows a plan view of the component surface 11, wherein one depression is denoted, representatively of all of the depressions provided in this case, by the reference numeral 13.

Figure 4:
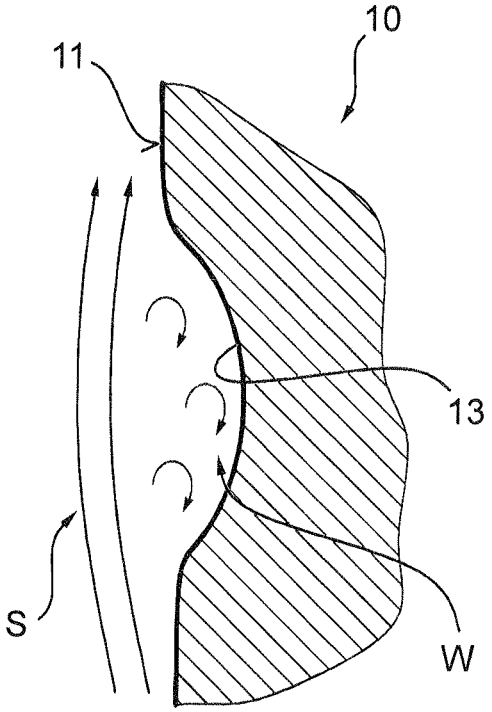
FIG. 4 shows an enlarged, schematically highly simplified illustration of a depression in the flow-conducting component surface of the exhaust-gas turbocharger component according to the invention.

FIG. 4 illustrates the operating principle of the invention. As a result of the provision of the depression 13 in the component surface 11 over which a flow, such as for example an air flow S, passes, vortices W are generated within the depression 13, which leads to a locally limited turbulent flow. This in turn reduces the air/flow resistance at the thermodynamic boundary layer, such that the maximum proportion of the air mass flow (in the case of the compressor) or of the exhaust-gas mass flow (in the case of the turbine) can form an at least approximately ideal laminar flow.

Figure 5:
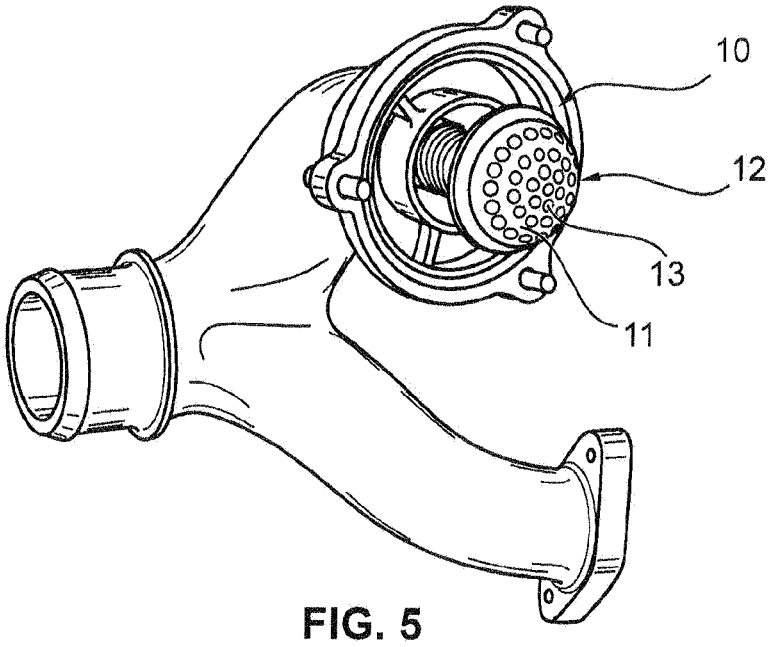
FIGS. 5, 6 show perspective illustrations of a self-regulating valve of an exhaust-gas turbocharger according to the invention with a closure body as a further example of an exhaust-gas turbocharger component according to the invention.
Figure 6:
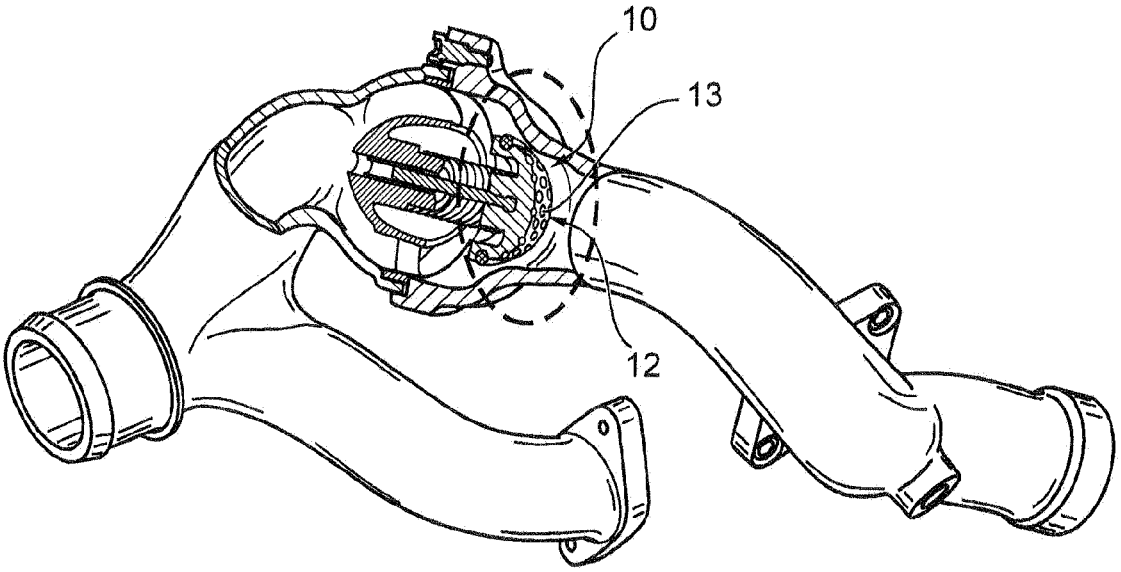

FIGS. 5 and 6 show perspective views of a further example of an exhaust-gas turbocharger 10 according to the invention, which in this case is formed by a closure body of a self-regulating valve for the exhaust-gas turbocharger 1. The illustrations of FIGS. 5 and 6 in turn show the discontinuity structure 12 which is formed from the above-described multiplicity of depressions 13 formed separately from one another on the component surface 11.

Figure 7:
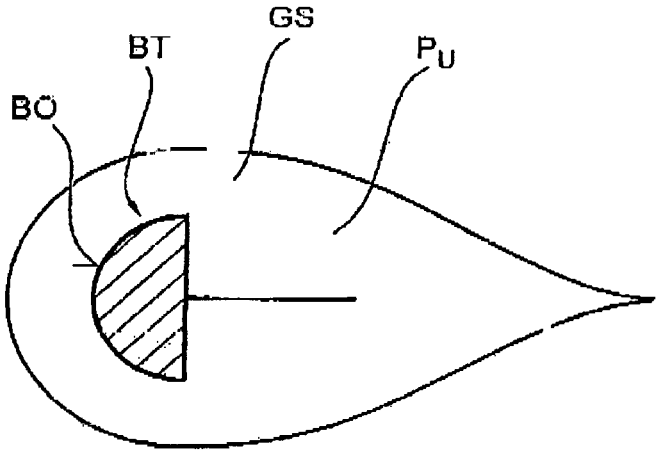
FIG. 7 (PRIOR ART)
FIGS. 7, 8 show diagrammatic illustrations for explaining the mode of operation according to the invention.

The operating principles of the invention will be explained once again below on the basis of said FIGS. 7 and 8. Here, FIG. 7 represents the prior art, in which a component BT schematically illustrated in FIG. 7 has a smooth surface BO. This results in a relatively thick boundary layer GS, which can lead to large flow losses.

Figure 8:
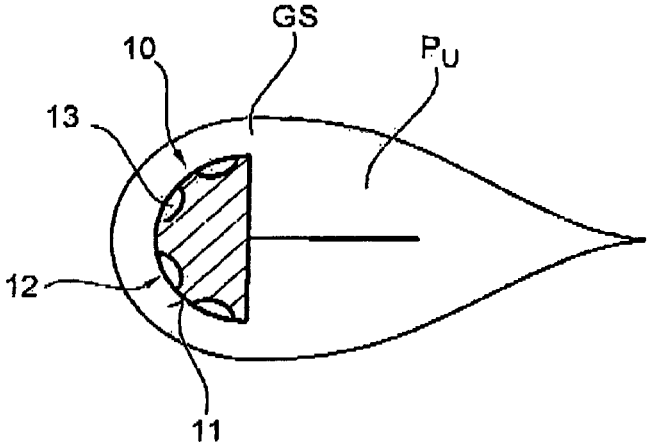

FIG. 8, in contrast, represents a component 10 according to the invention with the above-explained discontinuity structure 12 with its depressions 13. This results in a considerably reduced boundary layer thickness GS in relation to the prior art, which results in the above-explained advantageous effects.

In addition to the above written disclosure of the invention, reference is hereby explicitly made to the diagrammatic illustration of the invention in FIGS. 1 to 6 and 8.

LIST OF REFERENCE SYMBOLS

1 Exhaust-gas turbocharger
2 Compressor
3 Turbine
4 Compressor wheel
5 Turbine wheel
6 Bearing housing
7 Compressor housing
8 Turbine housing
9 Wastegate flap
10 Exhaust-gas turbocharger component
11 Component surface
12 Discontinuity structure
13 Depressions
S Gas flow (air or exhaust-gas flow)
W Flow vortex
BT Component
BO Component surface
GS Boundary layer
$P_U$ Negative pressure

The invention claimed is:

1. An exhaust-gas turbocharger component (10) with at least one flow-conducting component surface (11) and a discontinuity structure (12) which is formed on the component surface (11), wherein
the discontinuity structure (12) has a multiplicity of punctiform depressions (13) which are arranged separately from one another on at least one part of the component surface (11), wherein the punctiform depressions (13) are formed as a macrostructure in the range of tenths of a millimeter.

2. The exhaust-gas turbocharger component as claimed in claim 1, wherein the depressions (13) have different shapes.

3. The exhaust-gas turbocharger component as claimed in claim 2, wherein the depressions (13) are round, elliptical or polygonal.

4. The exhaust-gas turbocharger component as claimed in claim 1, wherein the depressions (13) are arranged on all the flow-conducting components (10) of an exhaust-gas turbocharger (1).

5. The exhaust-gas turbocharger component as claimed in claim 1, wherein the depressions are manufactured by casting.

6. An exhaust-gas turbocharger (1)
having at least one exhaust-gas turbocharger component (10) which
is provided with at least one flow-conducting component surface (11) and
which has a discontinuity structure (12) formed on the component surface (11), wherein
the discontinuity structure (12) has a multiplicity of punctiform depressions (13) which are arranged separately from one another on at least one part of the component surface (11), wherein the punctiform depressions (13) are formed as a macrostructure in the range of tenths of a millimeter.

7. The exhaust-gas turbocharger as claimed in claim 6, wherein the depressions (13) have different shapes.

8. The exhaust-gas turbocharger as claimed in claim 7, wherein the depressions (13) are round, elliptical or polygonal.

9. The exhaust-gas turbocharger as claimed in claim 6, wherein the depressions (13) are arranged on all the flow-conducting components (10) of an exhaust-gas turbocharger (1).

10. The exhaust-gas turbocharger as claimed in claim 6, wherein the depressions are manufactured by casting.

11. The exhaust-gas turbocharger as claimed in claim 6, wherein the discontinuity structure (12) is formed as a macrostructure in the range of tenths of a millimeter.

12. An exhaust-gas turbocharger component (10) with at least one flow-conducting component surface (11) having a discontinuity structure (12) on at least one part of the component surface (11), the discontinuity structure (12) comprising a multiplicity of round, elliptical or polygonal depressions (13) arranged separately from one another, the depressions (13) in the range of tenths of a millimeter.

* * * * *